US008132364B2

(12) United States Patent
Kania et al.

(10) Patent No.: US 8,132,364 B2
(45) Date of Patent: Mar. 13, 2012

(54) HIGHLY BUOYANT AND SEMI-RIGID FLOATING ISLANDS

(75) Inventors: Bruce G. Kania, Shepherd, MT (US); Frank M. Stewart, Bozeman, MT (US)

(73) Assignee: Fountainhead LLC, Shepherd, MT (US)

( * ) Notice: Subject to any disclaimer, the term of this patent is extended or adjusted under 35 U.S.C. 154(b) by 319 days.

(21) Appl. No.: 12/444,687

(22) PCT Filed: Oct. 2, 2007

(86) PCT No.: PCT/US2007/080234

§ 371 (c)(1),
(2), (4) Date: May 8, 2009

(87) PCT Pub. No.: WO2008/048778

PCT Pub. Date: Apr. 24, 2008

(65) Prior Publication Data

US 2010/0088955 A1 Apr. 15, 2010

Related U.S. Application Data

(60) Provisional application No. 60/862,444, filed on Oct. 21, 2006.

(51) Int. Cl.
*A01G 9/02* (2006.01)

(52) U.S. Cl. ..... 47/65.5; 14/27; 47/66.6; 405/219; 114/267

(58) Field of Classification Search ..... 47/65.5, 47/66.5, 66.6, 86, 87; 14/2.4, 2.6, 27, 75; 405/218–219; 119/208, 234, 238; 114/267
See application file for complete search history.

(56) References Cited

U.S. PATENT DOCUMENTS

| | | | | | |
|---|---|---|---|---|---|
| 2,565,369 | A | * | 8/1951 | Hamilton | 114/266 |
| 3,654,885 | A | * | 4/1972 | Godbersen | 114/266 |
| 3,842,768 | A | * | 10/1974 | Maistre | 114/312 |
| 3,927,491 | A | | 12/1975 | Farnsworth | |
| 4,000,850 | A | * | 1/1977 | Diggs | 126/613 |
| 4,037,360 | A | | 7/1977 | Farnsworth | |
| 4,086,161 | A | | 4/1978 | Burton | |
| 4,355,484 | A | * | 10/1982 | Mandish | 47/63 |
| 4,487,588 | A | | 12/1984 | Lewis, III et al. | |
| 4,536,988 | A | | 8/1985 | Hogen | |
| 4,777,763 | A | * | 10/1988 | Shannon et al. | 47/74 |
| 5,106,504 | A | | 4/1992 | Murray | |
| 5,133,151 | A | * | 7/1992 | Blok | 47/64 |
| 5,143,020 | A | | 9/1992 | Patrick | |
| 5,224,292 | A | | 7/1993 | Anton | |
| 5,261,185 | A | | 11/1993 | Koide et al. | |
| 5,312,601 | A | | 5/1994 | Patrick | |
| 5,337,516 | A | | 8/1994 | Hondulas | |
| 5,395,244 | A | * | 3/1995 | O'Neill | 434/151 |
| 5,528,856 | A | | 6/1996 | Smith et al. | |
| 5,666,772 | A | * | 9/1997 | Betty | 52/177 |

(Continued)

*Primary Examiner* — Rob Swiatek
*Assistant Examiner* — Ebony Evans
(74) *Attorney, Agent, or Firm* — Antoinette M. Tease

(57) ABSTRACT

A buoyant walkway or island and its method of manufacture. In a preferred embodiment, the buoyant walkway comprising: an internal frame comprising semi-rigid members that are attached to one another, said internal semi-rigid frame having openings; an internal block disposed in each of said openings, said internal blocks being spaced apart from one another by gaps and forming a top surface and a bottom surface; cured thermoplastic foam disposed in said gaps that attach said internal blocks to said semi-rigid internal frame and to one another; a permeable top layer that is attached to said top surface; and a bottom layer that is attached to said bottom surface.

8 Claims, 8 Drawing Sheets

U.S. PATENT DOCUMENTS 5,766,474 A 6/1998 Smith et al.
5,799,440 A 9/1998 Ishikawa et al.
5,836,108 A 11/1998 Scheuer
5,980,738 A 11/1999 Heitkamp et al.
6,014,838 A 1/2000 Asher
6,037,031 A * 3/2000 Jones et al. ..... 428/71
6,086,755 A 7/2000 Tepper
6,555,219 B2 4/2003 Kosinski
6,751,903 B2 * 6/2004 Shryock ..... 47/59 R
7,448,163 B2 * 11/2008 Beeman et al. ..... 47/65
2003/0051398 A1 3/2003 Kosinski
2003/0208954 A1 11/2003 Bulk
2005/0183331 A1 8/2005 Kania et al.
2006/0243659 A1 * 11/2006 Svirklys et al. ..... 210/602
2007/0209277 A1 * 9/2007 Schuck et al. ..... 47/59 R

* cited by examiner

HIGHLY BUOYANT AND SEMI-RIGID FLOATING ISLANDS

CROSS-REFERENCE TO RELATED APPLICATION

This application claims priority back to U.S. Patent Application No. 60/862,444, filed on 21 Oct. 2006.

BACKGROUND OF THE INVENTION

This invention relates to floating islands that are designed to provide highly buoyant, semi-rigid platforms for various applications such as walkways, roadways, docks, piers, water treatment facilities, and bird nesting habitat.

Some embodiments of the present invention may be used as alternatives to footbridges and vehicular bridges. They provide access across ponds, streams and bays, and also provide access to objects such as docks and islands that are situated in water bodies. Floating walkways and roadways may be preferable to conventional pile-supported bridges because they can be less expensive to construct, faster to install, easier to move, and more adaptable to water level fluctuations. Floating walkways and roadways may also be preferable to conventional bridges at locations where the water depth or bottom materials make pile-supported bridges difficult or expensive to install. Floating walkways and roadways may also be preferable at environmentally sensitive locations where the installation of conventional bridges would cause adverse impacts to wildlife or vegetation.

Some embodiments of the present invention may be used to treat contaminated water via mechanical and biological filtration, by circulating contaminated water through the island body for treatment. The relatively high level of buoyancy and semi-rigidity provided by the present invention makes the islands particularly suitable for supporting water pumps, air compressors, and other relatively heavy equipment. This equipment enables the islands to operate efficiently as water-quality remediation devices.

Some embodiments of the present invention may be used to replicate natural nesting habitat for certain birds (e.g., piping plovers) whose populations have diminished due to human-caused reduction in appropriate nesting areas. These birds prefer to nest in gravel flats located in proximity to water. The present invention provides the necessary buoyancy and rigidity to support nesting gravel beds, and thereby provides secure nesting habitat for these birds and other wildlife species.

The islands of the present invention may be manufactured in relatively small and easily transportable units, and then readily joined together at the deployment site to form large, highly buoyant semi-rigid structures. Alternately, an island may be manufactured as a single unit.

Background art floating platforms used as walkways, water treatment devices or nesting habitat obtain their buoyancy from pontoons or floats that are comprised of air-filled chambers or closed-cell foam blocks such as polystyrene foam. The foam blocks may be coated with a protective covering to reduce damage from impact and ultraviolet (UV) light.

Background art floating platforms have several limitations and deficiencies that are overcome by preferred embodiments of the present invention. Background art floating platforms are typically rectangular in shape and recognizable as man-made structures, and they are manufactured from materials that do not support the growth of plants on the top, edges, or interior of the structures. As a result of the materials and methods that are employed to construct background art floating platforms, these structures have low aesthetic value at locations where natural appearance is important. Background art floating platforms also tend to gradually lose buoyancy over time due to factors such as water absorption into the foam flotation, loss of flotation due to impact, ice damage, or waterlogging of the top surface.

Some water bodies experience contamination in the form of excess nutrient inflows from sources such as crop fertilizer, wastewater facility effluent and livestock waste runoff. These excess nutrients, which may include ammonia, nitrate, and phosphate, can promote algae growth and be toxic to fish, wildlife, and humans. Background art floating treatment platforms do not have the combination of high buoyancy, rigidity, natural appearance, and high treatment efficiency.

The background art is characterized by U.S. Pat. Nos. 5,224,292; 5,528,856; 5,766,474; 5,980,738; 6,086,755; and 6,555,219 and U.S. Patent Application Nos. 2003/0051398; 2003/0208954; 2005/0183331; the disclosures of which patents and patent applications are incorporated by reference as if fully set forth herein.

BRIEF SUMMARY OF THE INVENTION

The purpose of the invention is to provide highly buoyant and semi-rigid floating platforms that may be used to enable pedestrians and/or vehicles to cross bodies of water, or to treat contaminated water, or to provide wildlife nesting habitat. One advantage of preferred embodiments of the invention is that individual island units can be semi-rigidly connected so as to form a large, highly buoyant floating structure with high and uniform rigidity over the entire top surface. Another advantage of the invention is that open spaces can be designed between the individual units of a multiple-unit structure, and these spaces can be filled with plant bedding pockets, in order to provide a relatively low-cost means for adding plant-growing areas to the structure. For the purposes of this disclosure, the term "semi-rigid" means substantially rigid or rigid to at least some degree or rigid in at least some parts.

Another advantage of the invention that the interior of the island body may be comprised of zones with different levels of permeability and porosity, in order to promote a range of microbial growing conditions. For example, low permeability zones fabricated from fine-denier, tightly packed fibers would promote low-oxygen microbial growth conditions, while high permeability zones fabricated from coarse-denier, loosely packed fibers would promote high-oxygen microbial growth conditions. This combination of alternating aerobic and anaerobic zones within a single island body is particularly useful for performing certain multiple-step biological treatments. For example, ammonia is converted to inert nitrogen gas by the sequential steps of aerobic conversion of ammonia to nitrite, followed by aerobic conversion of nitrite to nitrate, followed by anoxic conversion of nitrate to nitrogen gas.

Another advantage of the invention is that the individual blocks of permeable material that make up the interior of the island may be pre-fabricated to standard size, and they may be manufactured so as to have particular buoyancy, permeability and porosity. They may optionally be fabricated wholly or partially from scrap materials that result from island construction or other manufacturing operations. Blocks with different characteristics may be combined within a single island to provide zones of different microbial growing conditions (e.g., aerobic and anaerobic).

Another advantage of the present invention is that the internal hollow semi-rigid frame of some embodiments may be used to transport water, air, and/or treatment additives (such as pH modifiers and carbon sources) into and through the interior of the permeable island body, thereby enhancing the effectiveness of the island for water quality treatment. In addition, the water and air may be either cooled or heated prior to injection in order to make them more effective for a particular treatment application.

In a preferred embodiment, the invention is a method of making a floating walkway comprising: providing a internal section that is permeable to water and buoyant in water and that has a top surface, said internal section preferably comprising a bi-cellular polymer foam or a nonwoven polymer matrix that contains at least one buoyant polymer foam inclusion; spraying a two-part foaming polyurethane resin onto and into said top surface to produce a foam layer; spraying a (preferably two-part) polyurea resin on said foam layer to form a top coat that becomes semi-rigid when it cures. Preferably, the method further comprises: adding a dye or pigment to said two-part polyurea resin before it is sprayed. Preferably, the method further comprises: sprinkling aggregate or sand onto said top coat before it has cured. Preferably, the method further comprises: adding a plurality of granular particles to said two-part polyurea resin before it is sprayed.

In another preferred embodiment, the invention is a buoyant walkway comprising: an internal frame comprising semi-rigid members that are attached to one another (preferably at substantially right angles), said internal semi-rigid frame having (preferably substantially rectangular openings); an internal block disposed in each of said rectangular openings, said internal blocks being spaced apart from one another by gaps and forming a top surface and a bottom surface; cured thermoplastic foam disposed in said gaps that attach said internal blocks to said semi-rigid internal frame and to one another; a permeable top layer preferably comprising a nonwoven matrix, an open cell polymer foam or a bi-cellular polymer foam, said permeable top layer being attached to said top surface; and a bottom layer preferably comprising a nonwoven matrix, an open cell polymer foam or a bi-cellular polymer foam, said permeable top layer being attached to said bottom surface. Preferably, each internal block is fabricated from a material selected from the group consisting of: a nonwoven matrix that is comprised of a plurality of polyester fibers or a plurality of polyethylene fibers or a plurality of polypropylene fibers that are intertwined to form a randomly oriented web or blanket; an open-cell foam that is comprised of a thermosetting polymer or a thermoplastic polymer; a bi-cellular polymer foam that is comprised of a thermosetting polymer or a thermoplastic polymer. Preferably, each internal block is fabricated from a combination comprising one or more compressed and bound together items selected from the group consisting of: a plurality of low-density nonwoven matrix pieces; a plurality of high-density nonwoven matrix pieces; a plurality of closed-cell polymer foam pieces; a plurality of bi-cellular foam pieces; and a plurality of open-cell foam pieces. Preferably, each low-density nonwoven matrix piece and/or high-density nonwoven matrix piece is comprised of a plurality of thermosetting fibers or a plurality of thermoplastic fibers. Preferably, each thermosetting fiber is a polyester fiber and each thermoplastic fiber is a polypropylene fiber or a polyethylene fiber. Preferably, adjacent internal blocks have different permeabilities. Preferably, adjacent internal blocks have different buoyancies.

In yet another preferred embodiment, the invention is an island assembly comprising: a first module that comprises a first semi-rigid internal frame, a first bottom layer that is attached to said first semi-rigid internal frame and a first permeable top layer that is attached to said first semi-rigid internal frame; and a second module that comprises a second semi-rigid internal frame, a second bottom layer that is attached to said second semi-rigid internal frame and a second permeable top layer that is attached to said second semi-rigid internal frame; wherein said first semi-rigid internal frame and said second semi-rigid internal frame are joined with a plurality of semi-rigid connectors. Preferably, the island assembly further comprises: a planting pocket having a pocket space, said planting pocket being disposed between said first module and said second module and being supported by said first semi-rigid frame and said second semi-rigid frame. Preferably, said planting pocket is comprised of a bi-cellular thermoplastic foam. Preferably, soil or bedding mix is disposed in said pocket space. Preferably, said planting pocket is adapted to extend below one or both of said semi-rigid internal frames. Preferably, said planting pocket comprises nonwoven matrix material that is adapted to prevent loss of said soil or bedding mix. Preferably, said modules have cutouts or holes that serve as planting pockets. Preferably, each said module is comprised of matrix trim or matrix wool and foam. Preferably, said cutouts or holes are lined with matrix sheet, open-cell foam or closed-cell foam. Preferably, the island assembly further comprises: matrix wool or coir that is disposed within said bedding pocket.

In a further preferred embodiment, the invention is a buoyant island array comprising: a first island assembly disclosed herein; and a second island assembly of disclosed herein that is connected to said first island assembly. Preferably, the buoyant island array further comprises: an external semi-rigid frame having spaces into which said modules are disposed. Preferably, the island assembly further comprises a continuous top layer that is attached to said permeable top layers. Preferably, said continuous top layer has planting cutouts that form pockets.

In another preferred embodiment, the invention is a floating island comprising: a modified semi-rigid frame that comprises members having a plurality of holes; a permeable top layer that is attached to said modified semi-rigid frame, said top layer having a top layer opening; and a bottom layer that is attached to modified semi-rigid frame, said bottom layer having a bottom layer opening. Preferably, the floating island further comprises a supplemental inlet pipe that is in fluid communication with said modified semi-rigid frame. Preferably, the floating island further comprises auxiliary equipment that is in fluid communication with said supplemental inlet pipe. Preferably, the auxiliary equipment is at least one item that is selected from the group consisting of: an air compressor with an optional cooler and/or an optional heater; a water pump with optional cooler and/or an optional heater; and a fluid pump for additives.

In yet another preferred embodiment, the invention is a method of making a floating walkway comprising: a step for providing an internal section that is permeable to water and buoyant in water and that has a top surface, said internal section comprising a bi-cellular polymer foam or a nonwoven polymer matrix that contains a buoyant polymer foam inclusion; and a step for mechanically fastening a molded form of polymer material onto said top surface to produce a top covering. Preferably, the method further comprises: a step for mechanically fastening a molded form of polymer material onto said top surface with a plurality of screws or glue.

In a further preferred embodiment, the invention is a method of making a floating walkway comprising: a step for injecting a thermoplastic polymer foam resin into a mold having a cavity; a step for operating said mold to produce a single molded piece that comprises, in the interior of said cavity, an interior foam section having a plurality of closed and/or open cell pores, that is permeable to water and buoyant in water and, at a surface of said mold, a top covering having substantially no cellular pores; and a step for placing said single molded piece in a water body with said top covering disposed over said interior section to produce the floating walkway.

In another preferred embodiment, the invention is a large array of buoyant islands comprising: a first arrangement of buoyant islands, each first arrangement of buoyant islands comprising more than one island assembly disclosed herein; and a second arrangement of buoyant islands that is connected to said first arrangement of buoyant islands, each second arrangement of buoyant islands comprising more that one island assembly disclosed herein.

In another preferred embodiment, the invention is a large array of floating islands comprising: more than one first module that comprises a first semi-rigid internal frame, a first bottom layer that is attached to said first semi-rigid internal frame and a first permeable top layer that is attached to said first semi-rigid internal frame; and more than one second module that comprises a second semi-rigid internal frame, a second bottom layer that is attached to said second semi-rigid internal frame and a second permeable top layer that is attached to said second semi-rigid internal frame; wherein each second semi-rigid internal frame is joined to a first semi-rigid internal frame with a plurality of semi-rigid connectors.

Further aspects of the invention will become apparent from consideration of the drawings and the ensuing description of preferred embodiments of the invention. A person skilled in the art will realize that other embodiments of the invention are possible and that the details of the invention can be modified in a number of respects, all without departing from the concept. Thus, the following drawings and description are to be regarded as illustrative in nature and not restrictive.

BRIEF DESCRIPTION OF THE SEVERAL VIEWS OF THE DRAWINGS

The features of the invention will be better understood by reference to the accompanying drawings which illustrate presently preferred embodiments of the invention.

Figure 1:
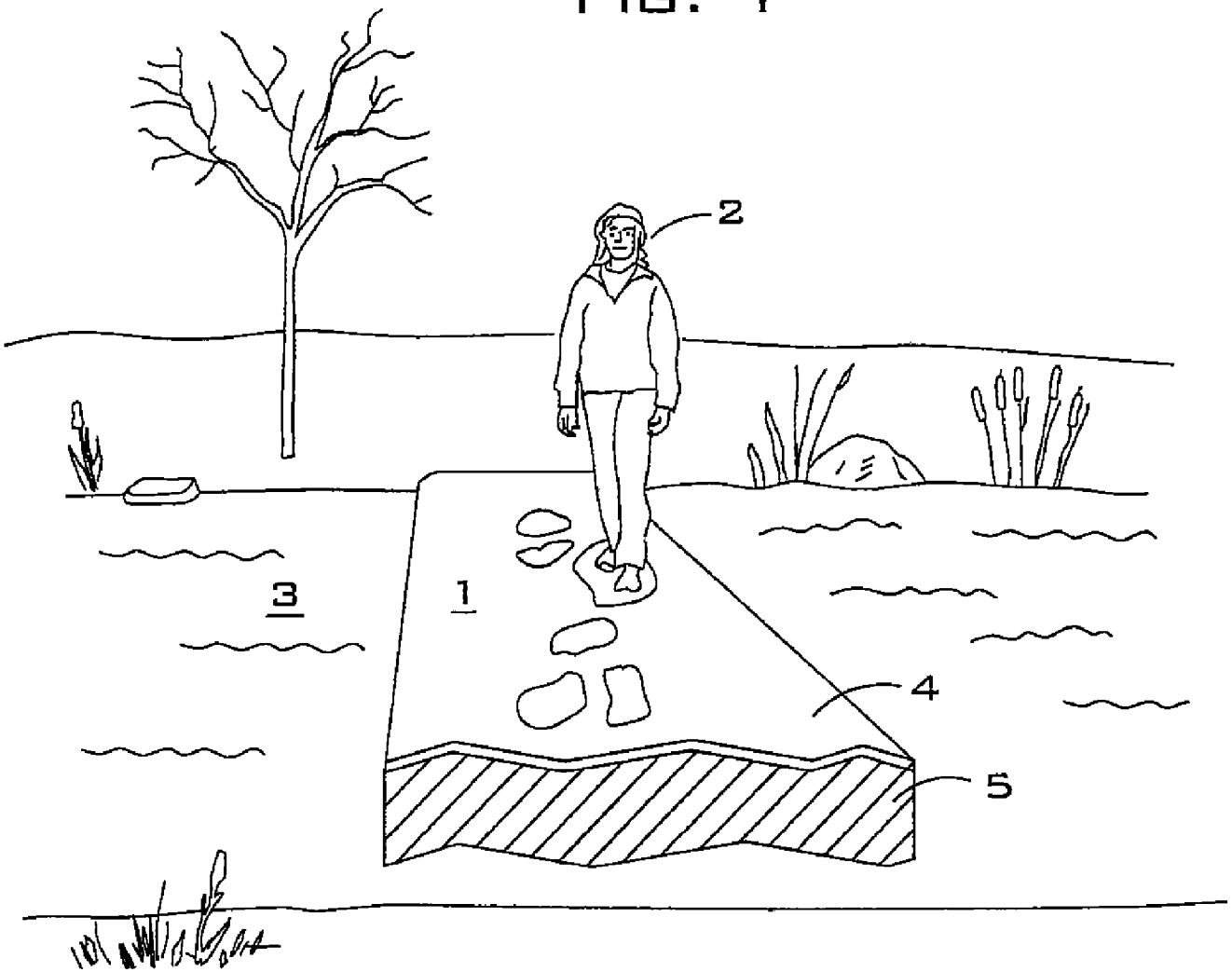
FIG. 1 is a perspective view of a preferred embodiment of the invention used as a floating walkway.

The following reference numerals are used to indicate the parts and environment of the invention on the drawings:

1 buoyant walkway, floating walkway, walkway structure, walkway, floating island
2 pedestrian
3 water body
4 semi-rigid top covering
5 permeable and buoyant interior
6 semi-rigid internal frame, internal frame, semi-rigid frame, frame
7 permeable top layer
8 island module, module
9 internal block, block
10 bottom layer
11 low-density nonwoven matrix pieces
12 high-density nonwoven matrix pieces
13 closed-cell polymer foam pieces
14 bi-cellular polymer foam pieces
15 open-cell polymer foam pieces
16 semi-rigid connectors
17 manufactured planting pockets, planting pocket, bedding holes
18 island array
19 continuous top layer
20 optional planting cutouts, cutouts
21 modified semi-rigid frame
22 holes
23 submersible pump assembly, pump assembly
24 opening
25 supplemental inlet pipe
26 opening in top layer
27 auxiliary equipment

DETAILED DESCRIPTION OF THE INVENTION

FIG. 1 illustrates a first embodiment of the invention. In this embodiment, the invention is used as a floating walkway to cross a stream. One end of the island has been removed to show the internal construction. As shown, floating walkway 1 is used by pedestrian 2 to cross water body 3. In this embodiment, rigidity for the floating walkway 1 is preferably provided by top covering 4, which is installed above interior section 5. Permeable and buoyant interior section 5 is preferably located beneath semi-rigid top covering 4. Top covering 4 is preferably impermeable to water, and impenetrable by plant stems or roots. Internal section 5 is preferably constructed so as to be buoyant, permeable to water, and penetrable by plant roots. In one embodiment, internal section 5 is comprised of nonwoven polymer matrix that is injected with buoyant polymer foam. In another embodiment, internal section 5 is comprised of bi-cellular polymer foam.

Plants (not shown) may optionally be grown through holes (not shown) provided in top covering 4. The roots of these plants'may grow through interior section 5 and may extend into water body 3 below walkway 1. Plants are useful for providing a natural appearance for walkway 1, and may also help stimulate the microbes within interior 5 to produce more buoyant gas than would occur without the plant roots, due to a symbiotic relationship between the roots and naturally occurring, gas-producing bacteria that colonize the interior section 5. In a preferred embodiment, plants selected to grow on present invention would include plants with buoyant roots. Examples of such plants include many plants that incorporate rhizomes as part of their propagation strategy. Examples of such plants include cattails, sweet flag, sea buckthorn, and buffalo grass. Plant growth materials such as peat or bedding soil may optionally be added to interior section 5 of walkway 1, or they may be installed into bedding pockets built into the top of walkway 1 to stimulate the growth of plants and microbes. Each walkway 1 may be constructed in any shape; for example, it may be shaped like a natural island or an extension of the shoreline.

In a first preferred embodiment, semi-rigid top layer 4 is constructed by first spraying on a rapid setting, two-part polyurethane resin that cures into a foam under-layer that extends approximately one inch into the top surface of internal section 5. The second step comprises spraying on a two-part polyurea resin that cures in place on top of the foam layer to form an approximately ¼-inch thick semi-rigid and durable top coat. Dye or pigment may be added to the top coat to provide the desired color and to increase the UV sunlight resistance of the top coat and the underlying foam layer. Aggregate or sand may optionally be attached to the top coat by sprinkling it onto the uncured, tacky top coat, and allowing it to bond during curing. The aggregate or sand may be used to provide a non-slip walking surface, or to attach nesting gravel for certain birds such as plovers, or for other purposes. Alternately, granular particles may be added to the top coat resin prior to spraying in order to provide a non-slip surface, or the surface may be mechanically roughened with a wire brush or similar tool after curing.

In a second preferred embodiment, top covering 4 is manufactured as a separate sheet or molded form of polymer material and mechanically fastened to the top of interior section 5 by screws, glue, or other conventional means.

In a third preferred embodiment, top covering 4 and interior section 5 may be manufactured as a single molded unit from a thermoplastic polymer such as polypropylene or polyethylene, by incorporating closed and/or open cell pores into the interior section 5, but not incorporating cellular pores into top covering 4 during the manufacturing process. This type of material is typically produced by injecting polymer foam resin into a mold for curing. As the foam expands and cures, the outer surface of the material presses against the inside surface of the mold, which causes the foam cells to collapse at the foam-mold interface, forming a non-foamed "skin" on the outer surface of the molded piece. This process is well known in the industry. Bicycle seats are an example of a molded polymer item which is comprised of a foam interior and a non-foam outer skin.

Figure 2:
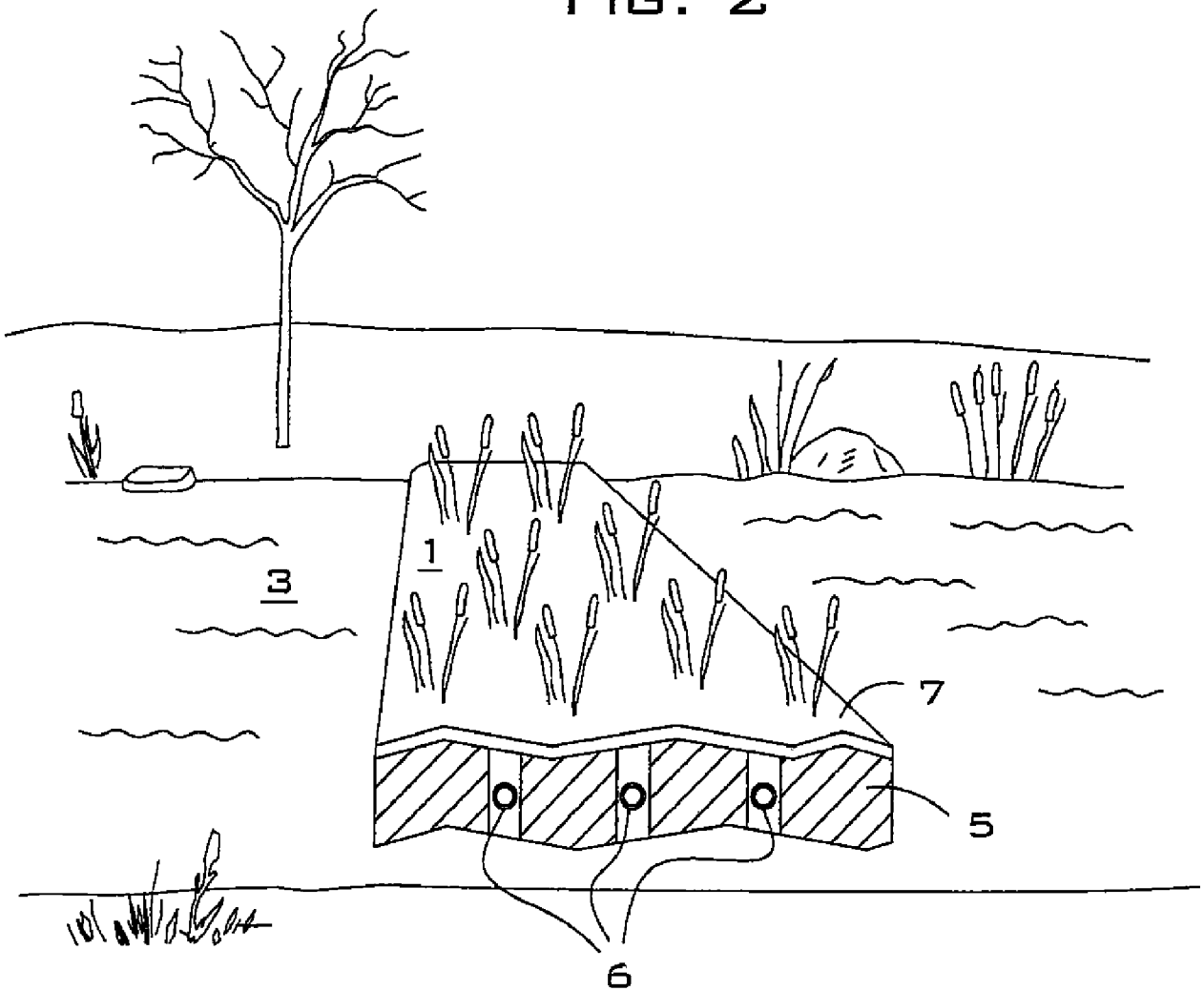
FIG. 2 is a perspective view of a preferred embodiment of the invention used as a water quality treatment device.

FIG. 2 illustrates a fourth preferred embodiment of the invention. In this embodiment, floating island 1 is used for water treatment. One end of floating island 1 has been removed to show the internal construction. Rigidity is provided by internal frame 6. Top layer 7 is permeable and penetrable by plant roots and sterns, thereby allowing plants to grow anywhere on the island's top surface. Water from water body 3 flows through the permeable interior section 5 of the body of floating island 1, where nutrients are removed from the water by microbes and macrophytes that reside on and within the island. Permeable top layer 7 is preferably made of nonwoven matrix, open-cell polymer foam, or bi-cellular polymer foam. Internal section 5 is preferably constructed so as to be buoyant, permeable to water, and penetrable by plant roots. In one embodiment, internal section 5 is comprised of nonwoven polymer matrix that is injected with buoyant polymer foam. In another embodiment, internal section 5 is comprised of bi-cellular polymer foam.

Nonwoven matrix is preferably comprised of polyester or polyethylene or polypropylene fibers that are intertwined to form a randomly oriented web or "blanket" with a standard thickness and width. In a preferred embodiment, nonwoven matrix is comprised of 200-denier polyester fibers that are intertwined to form a blanket approximately 1¾ inch thick by 56 inches wide (each layer of matrix is 1¾ inch thick—the nonwoven matrix is typically comprised of multiple layers; for example, a 4-layer nonwoven matrix is 7 inches thick). Nonwoven matrix preferably is produced in a continuous strip and cut to lengths of approximately 90 feet for shipping. The nominal weight of the blanket is preferably 41 ounces per square yard. The nominal weight of the polyester fibers within the blanket is preferably 26 ounces per square yard. A water-based latex binder is preferably baked onto the fibers of matrix to increase the stiffness and durability of the blanket.

The characteristics of the nonwoven matrix may be adjusted by varying the construction materials and manufacturing process. For example, the diameter of the fibers may be varied from approximately 6 to 300 denier. Coarse fibers result in a relatively stiff nonwoven matrix with relatively small surface area for colonizing microbes, and fine fibers result in a relatively flexible matrix with a relatively large surface area for colonizing microbes. The latex binder may be applied relatively lightly or relatively heavily to vary the durability and weight of nonwoven matrix, and dye or pigment can be added to the binder to produce a specific color of nonwoven matrix. The thickness of the blanket may be adjusted from approximately ¼-inch to 2 inches using preferred manufacturing techniques. The blankets with integral latex binder may be purchased as a manufactured item. One manufacturer of suitable nonwoven matrix material is Americo Manufacturing Company, Inc. of Acworth, Ga.

The polymer foam may be comprised of either thermosetting polymers or thermoplastic polymers. Polyurethane foam is an example of thermosetting foam. Polyethylene foam and polypropylene foam are examples of thermoplastic foams. Open-cell foam is permeable to water, and looses buoyancy when the cells become filled with water. Bi-cellular foam contains both open and closed cells, and therefore is both buoyant and permeable.

Figure 3:
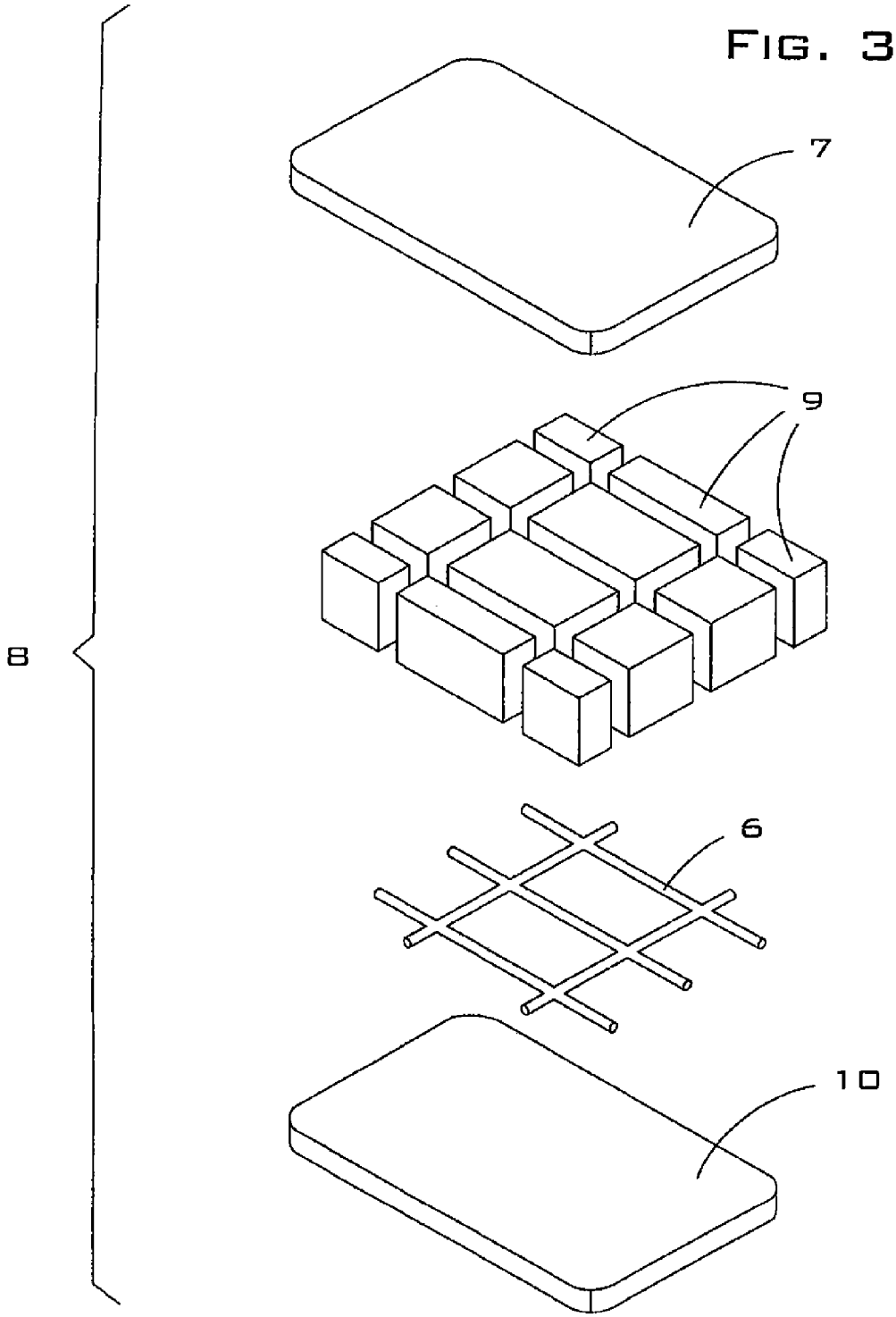
FIG. 3 is an exploded perspective view of a preferred embodiment of an island module with an internal semi-rigid frame.

FIG. 3 is an exploded perspective view of island module 8. Multiple modules 8 may be assembled to form a floating island similar to the one shown in FIG. 2. FIG. 3 illustrates the use of discrete internal blocks 9 that are inserted between the members of semi-rigid internal frame 6. Internal blocks 9 may optionally be attached to semi-rigid frame 6 by spraying uncured thermoplastic or thermosetting foam into the gaps between blocks 9 and frame 6, thereby forming an adhesive bond between blocks 9 and frame 6. Also shown are permeable top layer 7 and permeable bottom layer 10. Permeable top layer 7 and permeable bottom layer 10 are preferably made of nonwoven matrix, open-cell polymer foam, or bi-cellular polymer foam. Semi-rigid internal frame 6 may be manufactured from any suitable material that is semi-rigid and durable. Examples of suitable materials include polymer piping (such as polyvinylchloride (PVC) pipe), aluminum or fiberglass channels and beams, and steel reinforcing bar (rebar). The pipes and channels may optionally be filled with polymer foam to increase stiffness and promote long-term buoyancy.

Figure 4:
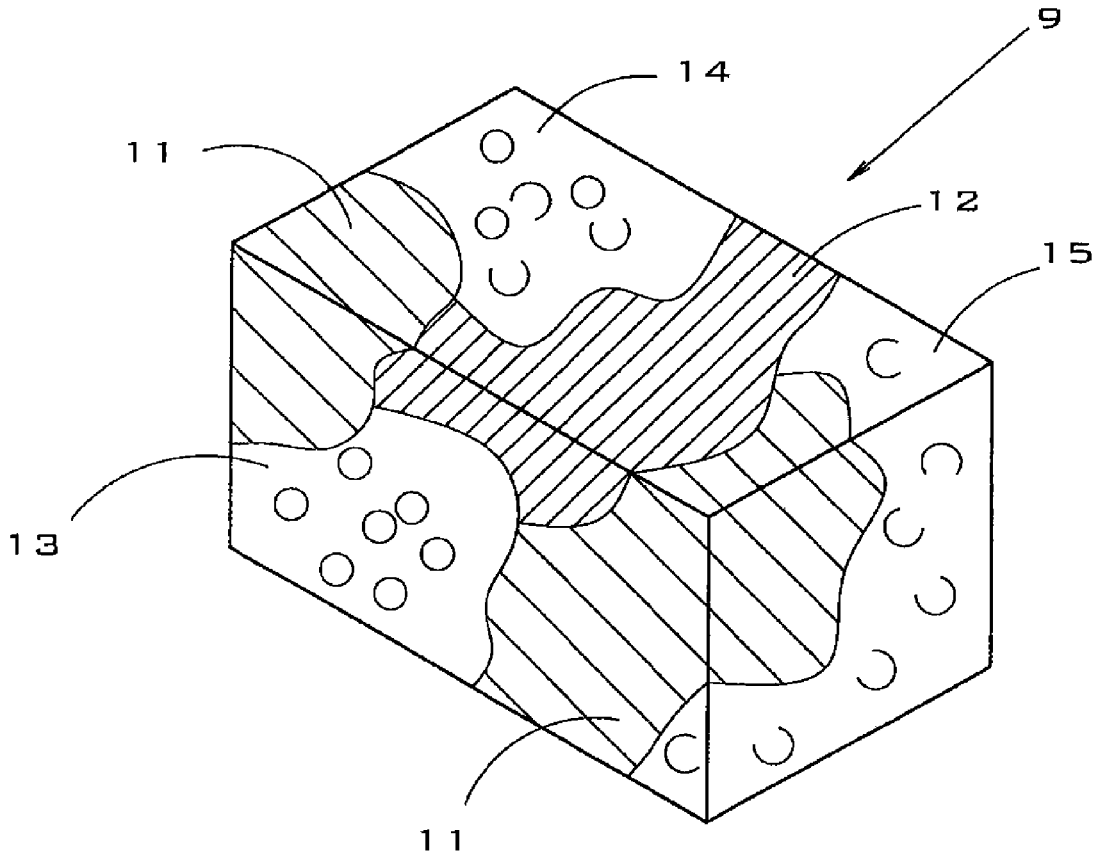
FIG. 4 is a perspective view of an internal block of composite materials.

FIG. 4 is a detailed drawing of one internal block 9. In this embodiment, block 9 is formed by compressing and binding together a combination of one or more of the following items: pieces of low-density nonwoven matrix 11, pieces of high-density nonwoven matrix 12, pieces of closed-cell polymer foam 13, pieces of bi-cellular polymer foam 14, and pieces of open-cell polymer foam 15.

The nonwoven matrix of internal blocks 9 may be comprised of either thermosetting fibers or thermoplastic fibers. An example of a thermosetting fiber is polyester. Examples of thermoplastic fibers are polypropylene and polyethylene. The polymer foam of internal blocks 9 may be comprised of either thermosetting polymers or thermoplastic polymers. Polyurethane foam is an example of thermosetting foam. Polyethylene foam and polypropylene foam are examples of thermoplastic foams. Closed-cell foam is non-permeable and very buoyant due to trapped gasses within the cells. Open-cell foam is permeable to water, and looses buoyancy when the cells become filled with water. Bi-cellular foam contains both open and closed cells, and therefore is both buoyant and permeable. The ratio of closed to open cells in bi-cellular foam may be intentionally set during manufacture to obtain the desired properties of buoyancy and permeability for a particular application. The nonwoven matrix may be manufactured over a wide range of fiber deniers and fabric densities.

By adjusting the ratio of materials comprising an internal block 9 during manufacture, the overall buoyancy and permeability of the block may be controlled. For example, water that flows through internal blocks having high permeability will tend to remain aerobic, since fresh, oxygen-bearing water will flow rapidly into the internal blocks, bringing new oxygen to replace the oxygen that is used during aerobic microbial water treatment. Aerobic zones are useful for microbial conversion of ammonia to nitrate and phosphate to microbial cell mass. Water that flows through blocks of low permeability will tend to become anaerobic, as microbes deplete dissolved oxygen in the water faster than it can be replenished by new oxygen. Anaerobic zones are useful for microbially conversion of nitrate to nitrogen gas. It may be desirable to incorporate internal blocks 9 with different permeabilities into a single floating island module 8. Blocks 9 of alternating high and low permeability may be placed adjacent to one another within module 8 to provide sequential zones of aerobic and anaerobic microbial activity, which is desirable for the multiple-step process of conversion of ammonia to nitrogen gas.

It may also be desirable to combine internal blocks having different buoyancies within a single island. For example, internal blocks 9 comprising a large percentage of closed-cell foam may be located within an island under locations where heavy objects such as pumps may be placed, while internal blocks containing less closed-cell foam are used for the remainder of the island body, in order to provide maximum water circulation and microbial treatment capacity at locations where maximum buoyancy is not required.

The various components of internal blocks 9 may be made from newly manufactured materials; alternately, scrap pieces of materials may be incorporated into the blocks. In one test using a combination of scrap materials and new material, 500 pounds of reserve buoyancy was measured on an island module that was 5 feet wide, 8 feet long, and 1 foot thick. In another test, 2,000 pounds of reserve buoyancy was measured in an island module that was 5 feet wide, 8 feet long, and 20 inches thick.

Figure 5:
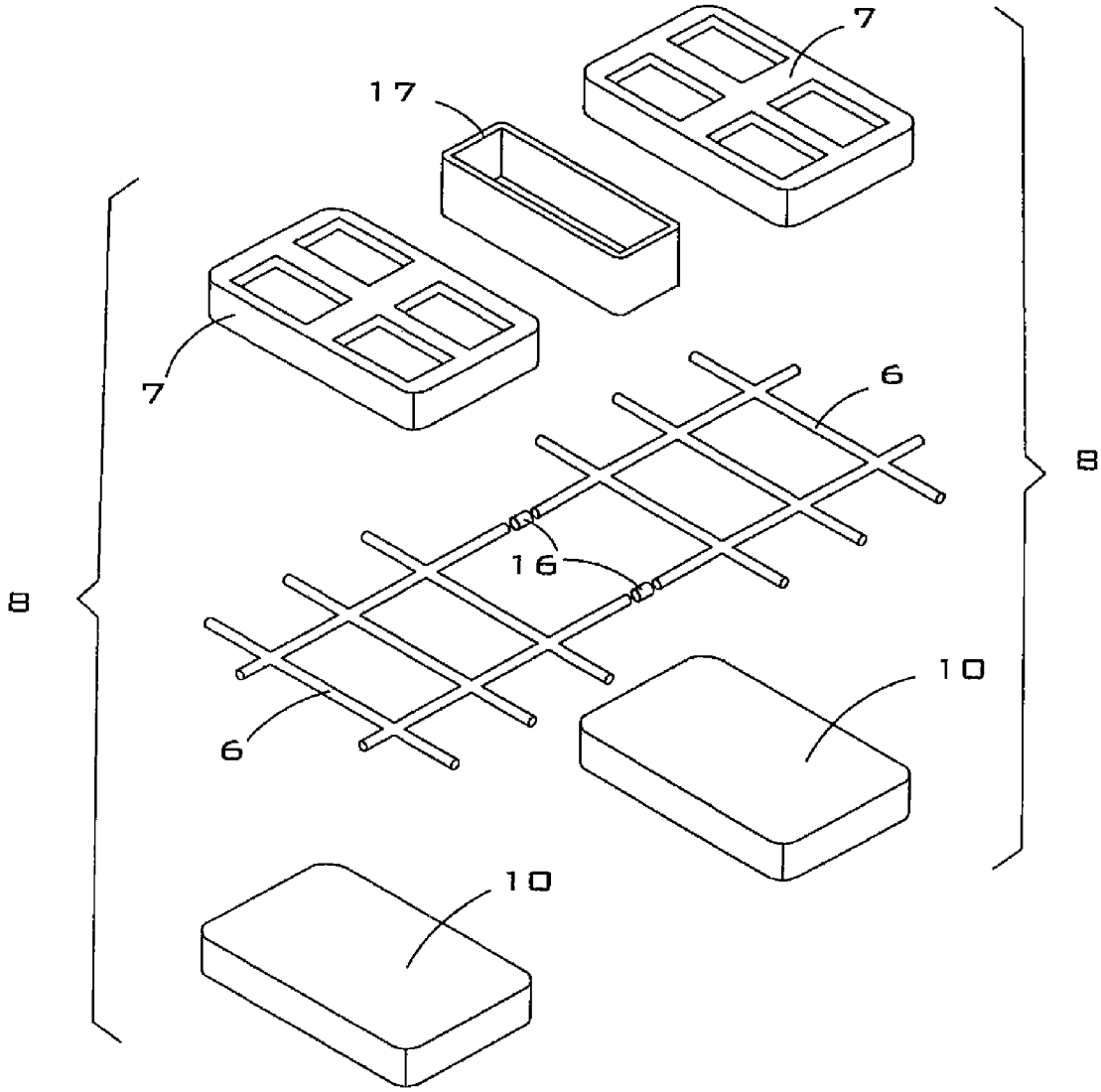
FIG. 5 is an exploded perspective view of two island modules joined together in a preferred embodiment with an intermodule planting pocket.

FIG. 5 is an exploded perspective view that illustrates the joining of multiple island modules 8 with inter-module planters, in order to produce a larger island assembly. For clarity, only two modules are shown, but any number may be connected. Each module of this embodiment comprises bottom layer 10, semi-rigid internal frame 6, and permeable top layer 7. The internal frames 6 of adjacent modules are joined with semi-rigid connectors 16. Manufactured planting pockets 17 are installed between the modules 8 and are supported by semi-rigid frames 6. Thus, semi-rigid frame 6 also provides a means for suspending planting pockets 19 that are positioned between modules 8. This is expected to help control the costs of manufacturing such a design. Planting pockets 17 are useful for providing extra plant growth surface for the island assembly. Planting pockets 17 are preferably manufactured from bi-cellular thermoplastic foam that is lightweight and porous, and capable of retaining soil or bedding mix within the pocket space. Although only one planting pocket is shown in this figure, pockets may be placed on all sides of each module in an island assembly.

Planting pockets 17 may have any depth. It is important for certain classes of plants for their roots to be exposed to dissolved oxygen. One way to accomplish this is to provide planting pockets 17 that are sufficiently deep to allow aerated water occurring below semi-rigid internal frame 6 to readily communicate with the foam or nonwoven matrix walls of planting pockets 17. In preferred embodiments, the walls of planting pockets 17 are made of nonwoven matrix material that is sufficiently dense to prevent loss of bedding mix.

In another embodiment, planting pockets 17 are simple cutouts in module 8 and do not have separate foam or matrix walls. In this embodiment, the foam or matrix packed within each semi-rigid module 8 serves as the walls of each of the planting pockets 17. In this embodiment, each of the planting pockets 17 is preferably sufficiently deep to allow for the water level of water body 3 to extend into it. Then, plants may be positioned in planting pocket 17 and allowed to grow hydroponically, with or without provision of bedding mix. In this embodiment, wicking of water would not be required.

Figure 6:
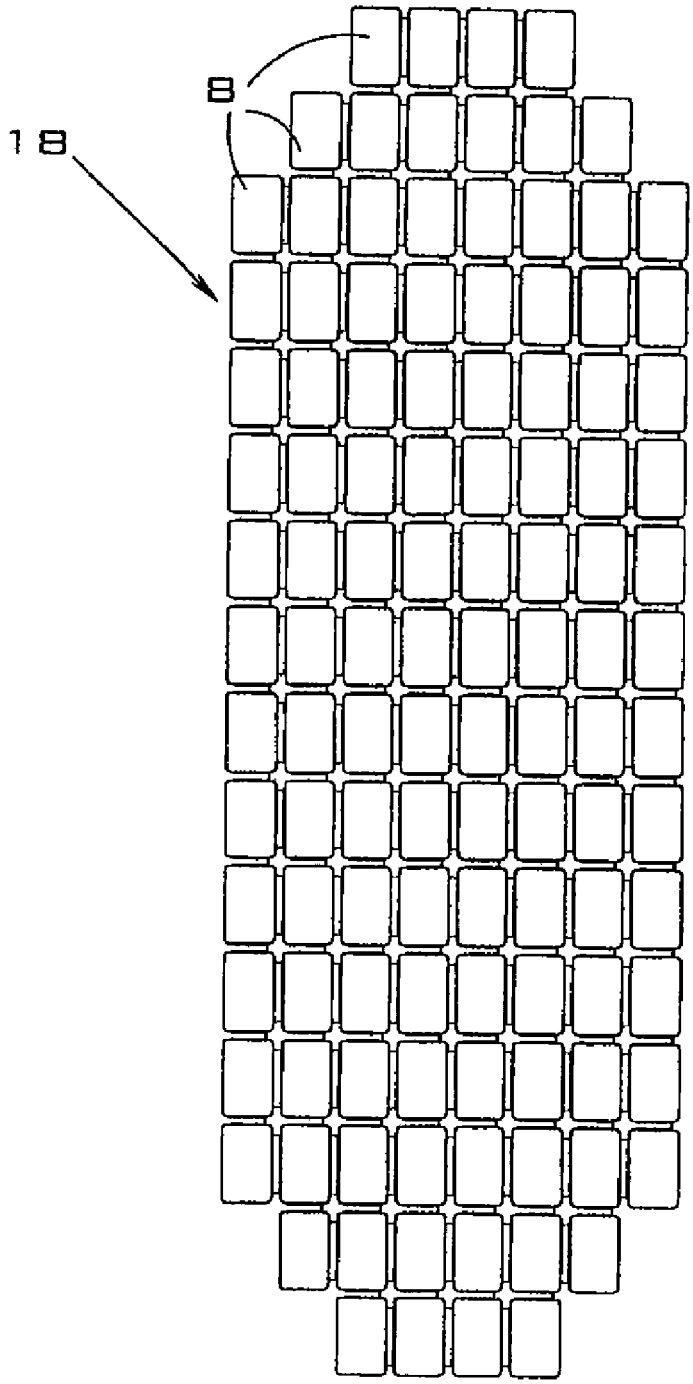
FIG. 6 is a top view of an array comprised of island modules.

FIG. 6 is a top view of an array 18 of modules 8. In this figure, each individual module 8 is five feet wide by eight feet long, with one-foot wide planting pockets 17 situated between each of the modules. There are 116 modules 8 in the array 18. The resulting array 18 has a length of 142 feet and a width of 46 feet. The island modules 8 that are shown in FIG. 5 and FIG. 6 comprise semi-rigid internal frames 6. In an alternate embodiment (not shown), an island array 18 may be assembled using an external semi-rigid frame similar to the frame shown in FIG. 5. With the external-frame embodiment, island modules (without internal frames) are dropped into a preassembled external frame, thereby forming an array that performs similarly to array 18 shown in FIG. 6.

In a preferred embodiment, each module 8 is filled with matrix trim or matrix wool. For the purposes of this disclosure, the term "matrix wool" is defined matrix material that has been processed by passing it through a wood chipper. The matrix wool is preferably compressed into a five foot by eight foot sandwich or module 8. Foam is then injected into module 8 to achieve the desired buoyancy level. Planting pockets or bedding holes 17 may then be drilled into modules 8, but the edges of the drilled holes are not as uniform as holes that are lined with matrix sheet material or open-celled or closed-cell foam. When bedding mix is introduced into drilled bedding holes in the presence of water, it may escape. This is due to gaps that invariably occur between the individual pieces of matrix trim or matrix wool that are present in module 8. Thus, bedding mix may not be adequately contained in these bedding holes 17, but plants can be grown in the water that seeps into bedding holes 17 on a straightforward, hydroponic basis. Bedding plants can be supported in these bedding holes 17 if matrix wool or coir is packed around the plants. However, with high integrity matrix sheet, open-cell foam or closed cell foam lining bedding holes 17, bedding mix can be contained within bedding holes 17. This allows for bedding plants as well as seeds to be plantable within bedding holes 17 without bedding mix being lost.

Figure 7:
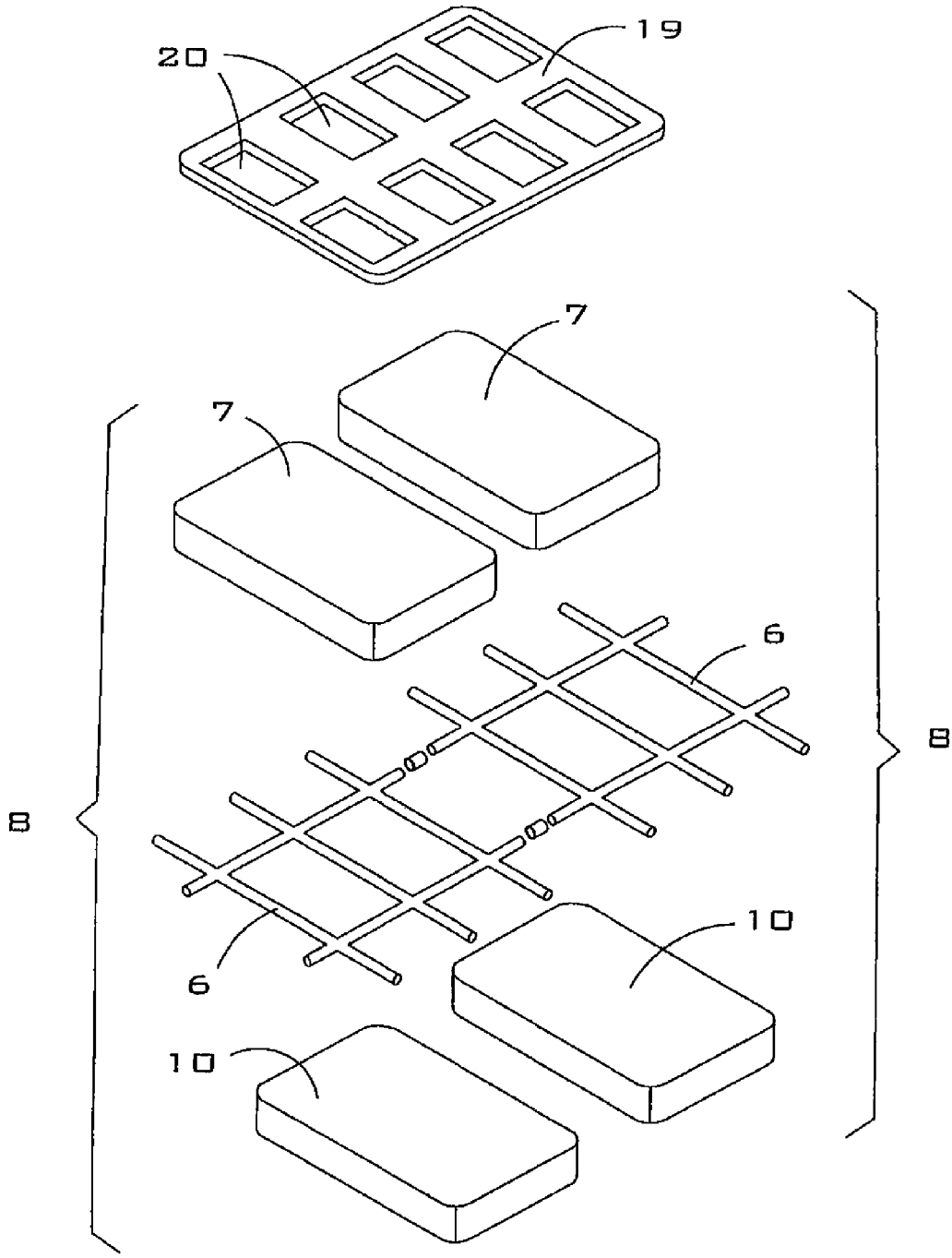
FIG. 7 is an exploded perspective view of two island modules joined together in a preferred embodiment with a continuous top layer.

In a less preferred embodiment, matrix trim or matirx wool is packed more tightly in modules 8, which reduces the size of the gaps that allow bedding mix to escape from bedding holes 17. In this embodiment, it is harder for water to filter through modules 8. However, in some embodiments, use of one or more of all three of these systems, unlined holes within modules 8, holes in modules 8 that are lined with matrix, and holes in modules 8 that are lined with open-cell or closed-cell foam, is envisioned by the applicants. Using matrix wool or coir to support bedding plants in a hydroponic condition in unlined holes within modules 8 is also envisioned in some embodiments. FIG. 7 is an exploded perspective view that illustrates the joining of multiple island modules 8 with no inter-module planters or spaces, in order to produce a large island with a continuous top surface. Each module 8 of this embodiment comprises bottom layer 10, semi-rigid internal frame 6, and permeable top layer 7. Continuous top layer 19 is installed after the modules 8 have been joined. The purpose of continuous top layer 19 is to cover the seams between the modules 8, thereby providing a seamless top surface. Optional planting cutouts 20 that form pockets in continuous top layer 19 are shown in this figure. Cutouts 20 may be filled with bedding mix to stimulate plant growth. In an alternate embodiment, cutouts 20 may be filled with gravel or a lightweight gravel substitute such as perlite. The gravel pockets can serve as nesting habitat for plovers and other birds that prefer this type of habitat. Alternately, continuous top layer 19 may be manufactured without cutouts, so as to provide a uniform flat surface. A uniform surface may be preferred for applications such as floating golf greens. Although only two modules 8 are shown in the figure, any number may be joined together in this embodiment.

Figure 8:
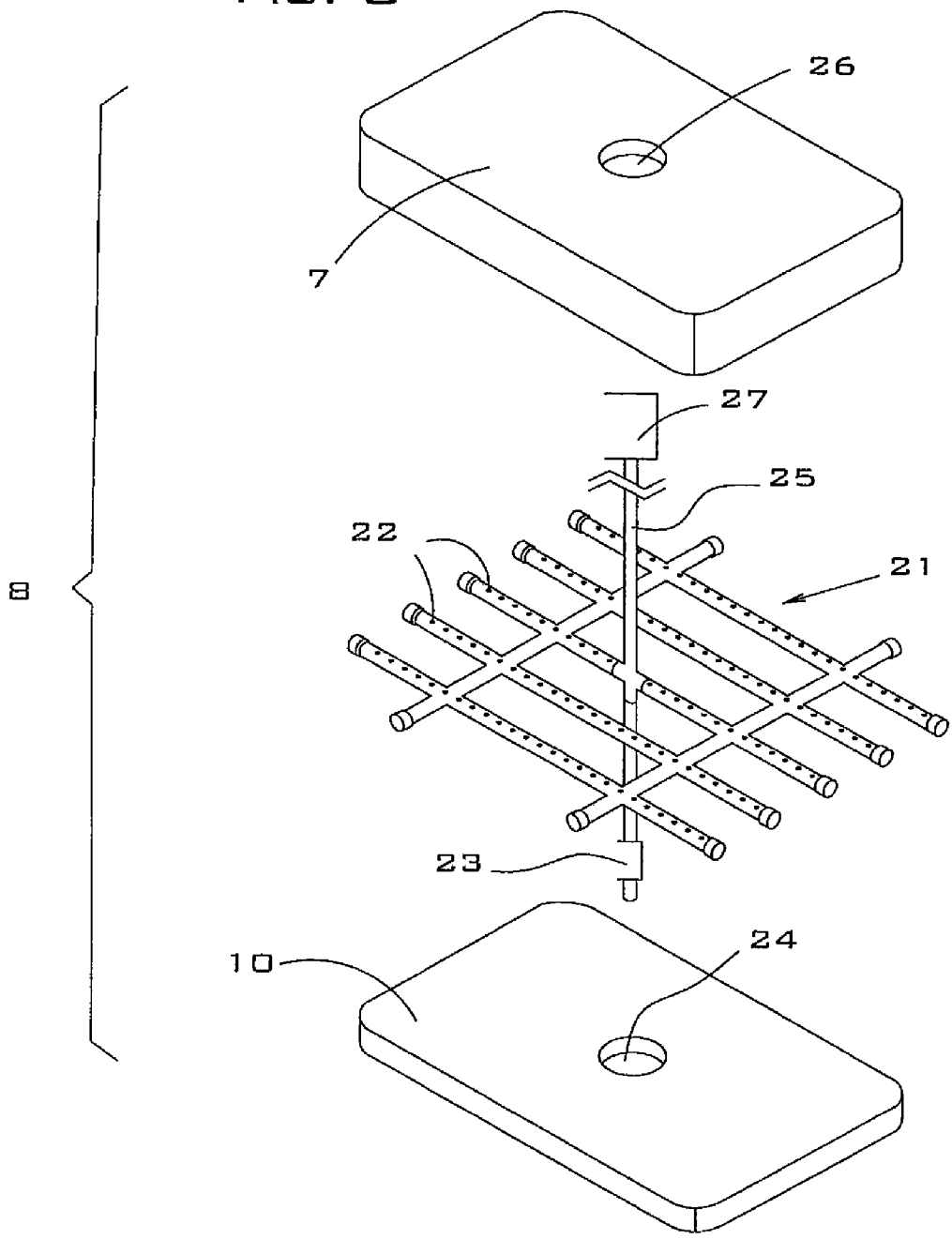
FIG. 8 is an exploded perspective view of a preferred embodiment of an island module with an internal frame used to circulate water, air and/or treatment additives through the island body.

FIG. 8 is an exploded perspective view of an alternative embodiment of the invention in which the semi-rigid frame has been modified to introduce water, air, and/or treatment additives into the body of floating island 1. As shown in the figure, modified semi-rigid frame 21 has holes 22 along its members. Submersible pump assembly 23 is attached to the bottom side of modified semi-rigid frame 21. Pump assembly 23 passes through opening 24 in bottom layer 10 when the module is assembled. The purpose of this embodiment is to force untreated, nutrient-rich water through the permeable portions of the body of floating island 1, thereby providing a continuous flow of untreated water to the internal regions of the island. This enhanced internal flow may result in increased removal efficiency of water-borne nutrients, by increasing the nutrient availability to microbes and plant roots within the interior portions of floating island 1. The system operates as follows: pump 23 withdraws water from the water body beneath floating island 1, and discharges the water into top layer 7 and bottom layer 10 through frame holes 22. The water percolates through the permeable layers 7, 10 and is discharged into water body 3 along the outside edges of floating island 1. Pump 23 may be powered by solar energy, wind power or commercial grid electricity (power sources not shown). In an alternate embodiment (not shown), modified semi-rigid frame 21 may be used to discharge air, or a mixture of air and water into the permeable layers 7, 10. This embodiment may be useful for applications where additional aeration is beneficial; for example, to promote the growth of terrestrial plants or aerobic bacteria.

Additional fluids such as air, pH modifiers, and carbon-rich microbial food sources may be optionally introduced into the island body via supplemental inlet pipe 25, which passes through top layer opening 26 and is connected to auxiliary equipment 27, which is shown schematically. Auxiliary equipment 27 may comprise a combination of one or more of the following components: air compressor with optional cooler and/or heater, water pump with optional cooler and/or heater, fluid pump for additives such as pH modifiers, carbon sources, and plant nutrients.

The purpose of the compressed air is to increase the concentrations of oxygen and carbon dioxide within the body of floating island 1 in order to promote microbial and plant growth. The purpose of injecting microbial and plant nutrients is to promote the growth of microbes and plants, in the event that water body 3 is deficient in one or more desirable nutrients that are required to enable the microbes and plants to efficiently remove undesirable water-borne nutrients. The purpose of heating or cooling the injected air and water is to provide more ideal growing conditions for microbes and plants under specific conditions. For example, warming the water and air during wintertime may increase the metabolic rates of microbes within the island, thereby increasing nutrient removal rates; cooling the water and air during summertime will enable the water to contain more dissolved oxygen, which may beneficial to aerobic microbial metabolism and plant growth. The purpose of pH modifiers is to provide optimum growing conditions for microbes and plants in specific operating conditions. For example, microbes may need supplemental addition of alkalinity when removing ammonia from low-pH waters.

Many variations of the invention will occur to those skilled in the art. Some variations include multiple or single modules. Other variations call for incorporation of equipment. All such variations are intended to be within the scope and spirit of the invention.

Although some embodiments are shown to include certain features, the applicant(s) specifically contemplate that any feature disclosed herein may be used together or in combination with any other feature on any embodiment of the invention. It is also contemplated that any feature may be specifically excluded from any embodiment of the invention.

What is claimed is:

1. An island assembly comprising:

a first module that comprises a first semi-rigid internal frame, a first bottom layer that is attached to said first semi-rigid internal frame and a first permeable top layer that is attached to said first semi-rigid internal frame; and a second module that comprises a second semi-rigid internal frame, a second bottom layer that is attached to said second semi-rigid internal frame and a second permeable top layer that is attached to said second semi-rigid internal frame;

wherein said first semi-rigid internal frame and said second semi-rigid internal frame are joined with a plurality of semi-rigid connectors; and a planting pocket having a pocket space, said planting pocket being disposed between said first module and said second module and being supported by said first semi-rigid frame and said second semi-rigid frame.

2. The island assembly of claim 1 wherein said planting pocket is comprised of a bi-cellular thermoplastic foam.

3. The island assembly of claim 1 wherein soil or bedding mix is disposed in said pocket space.

4. The island assembly of claim 3 wherein said planting pocket comprises nonwoven matrix material that is adapted to prevent loss of said soil or bedding mix.

5. The island assembly of claim 1 wherein said planting pocket is adapted to extend below one or both of said semi-rigid internal frames.

6. The island assembly of claim 1 further comprising:

matrix wool or coir that is disposed within said planting pocket.

7. A buoyant island array comprising:

a first island assembly comprising:

a first module that comprises a first semi-rigid internal frame, a first bottom layer that is attached to said first semi-rigid internal frame and a first permeable top layer that is attached to said first semi-rigid internal frame; and a second module that comprises a second semi-rigid internal frame, a second bottom layer that is attached to said second semi-rigid internal frame and a second permeable top layer that is attached to said second semi-rigid internal frame;

wherein said first semi-rigid internal frame and said second semi-rigid internal frame are joined with a plurality of semi-rigid connectors;

a second island assembly that is connected to said first island assembly; and an external semi-rigid frame having spaces into which said modules are disposed.

8. An island assembly comprising:

a first module that comprises a first semi-rigid internal frame, a first bottom layer that is attached to said first semi-rigid internal frame and a first permeable top layer that is attached to said first semi-rigid internal frame; and a second module that comprises a second semi-rigid internal frame, a second bottom layer that is attached to said second semi-rigid internal frame and a second permeable top layer that is attached to said second semi-rigid internal frame;

wherein said first semi-rigid internal frame and said second semi-rigid internal frame are joined with a plurality of semi-rigid connectors; and wherein said top layer has planting cutouts that form pockets.

* * * * *